United States Patent [19]

Harrison et al.

[11] Patent Number: 4,885,062

[45] Date of Patent: Dec. 5, 1989

[54] LUBE OIL SOLVENT DEWAXING CONTROL SYSTEM

[75] Inventors: Charles W. Harrison, Houston, Tex.; Michael J. Gerondale, Glendale, Ariz.; Anthony J. Patrone, Port Arthur; James O. Y. Ong, Houston, both of Tex.

[73] Assignee: Texaco Inc., White Plains, N.Y.

[21] Appl. No.: 209,123

[22] Filed: Jun. 20, 1988

[51] Int. Cl.[4] ..... C10G 73/34

[52] U.S. Cl. ..... 196/14.5; 208/33; 208/38; 208/DIG. 1

[58] Field of Search ..... 196/14.5, 14.52; 208/33, 37, 38, DIG. 1; 364/500, 502; 62/540

[56] References Cited

U.S. PATENT DOCUMENTS 3,249,526 5/1966 Bodington ..... 208/33

4,262,790 4/1981 Castiglione ..... 196/14.5

*Primary Examiner*—Joye L. Woodard

*Attorney, Agent, or Firm*—Jack H. Park; Kenneth R. Priem; Richard A. Morgan

[57] ABSTRACT

A control system controls a lubricating oil dewaxing apparatus. The temperature of waxy oil flowing through the apparatus is controlled. A sequential plurality of temperature sensing means senses the temperature of the waxy oil. A Comparing Means determines an isothermal heat transfer zone corresponding to latent heat transfer wax crystallization. Temperature upstream of the isothermal zone is controlled to a selected chilling rate. Temperature downstream of the isothermal zone is controlled to a selected filtering temperature. The control system effects the growth of wax crystals of a uniform and moderate size for optimum filtering rate and oil content.

18 Claims, 2 Drawing Sheets

LUBE OIL SOLVENT DEWAXING CONTROL SYSTEM

BACKGROUND OF THE INVENTION

1. Field of the Invention

This invention relates to the control system for a lubricating oil solvent dewaxing apparatus. In particular, the invention is a system which controls the temperature of waxy oil in the apparatus, to cause the growth of wax crystals of a uniform and moderate size.

2. Description of Related Methods in the Field

It is known in the art to dewax waxy petroleum oil stocks by cooling oil-solvent solutions at uniformly slow rates, of e.g. 1° to 8° F./min., (0.56° to 4.4° C./min.), under controlled conditions for crystallization of wax from said solutions. Commercially, such oil-solvent solutions are cooled by several methods such as indirect heat exchange in scraped surface exchangers; dilution chilling wherein waxy oil stock is contacted in a multistage tower with chilled solvent under conditions of high levels of agitation (U. S. Pat. No. 3,773,650); and direct chilling, wherein a low boiling solvent, e.g. propylene, mixed with waxy oil stock is vaporized under conditions of reduced pressure.

In such commercial processes, the waxy oil charge, or solutions of waxy oil charge and solvent, are heated to a temperature at which the wax is dissolved. The heated charge is then passed into a cooling zone wherein cooling is undertaken at a uniform slow rate in the range of about 1° to 8° F./min. (0.56° to 4.4° C./min.) until a temperature is reached at which a substantial portion of the wax is crystallized and at which dewaxed oil product has a selected pour point temperature. Upon achieving the desired dewaxing temperature, the mixture of wax crystals, oil and solvent is subjected to solid-liquid separation for recovery of a wax free oil-solvent solution and a solid wax containing a minor proportion of oil (slack-wax). The separated oil-solvent solution is subjected to distillation for recovery of a solvent fraction and a dewaxed oil product fraction. The slack wax may be recovered as is, or may be subjected to additional processing, such as repulp filtration for removal of additional oil therefrom.

Solid-liquid separation techniques which may be employed for separation of wax crystals from the oil-solvent solutions include known solid-liquid separation processes, such as gravity settling, centrifugation, and filtration. Most commonly, in commercial processes, filtration in a rotary vacuum filter, followed by solvent wash of the wax cake, is employed.

Dewaxing solvents which may be used in solvent dewaxing processes include known dewaxing solvents. Commonly used solvents include aliphatic ketones of 3–6 carbon atoms, $C_2$–$C_4$ range hydrocarbons, $C_6$–$C_7$ aromatic hydrocarbons, halogenated $C_1$–$C_4$ hydrocarbons, an mixtures of such solvents.

Solvents known to be useful as dewaxing solvents are the ketones containing 3 to 6 carbon atoms, for example, acetone, methylethylketone (MEK) and methylisobutylketone (MIBK); mixtures of ketones; and mixtures of ketones with aromatic hydrocarbons including benzene and toluene. Halogenated low molecular weight hydrocarbons, including dichloromethane and dichloroethane, and their mixtures are also known dewaxing solvents. Solvent dilution of wax oil stocks maintains fluidity of the oil for facilitating easy handling, for obtaining optimum wax-oil separation, and for obtaining optimum dewaxed oil yields. The extent of solvent dilution depends upon the particular oil stocks and solvents used, the approach to filtration temperature in the cooling zone and the desired final ratio of solvent to oil in the separation zone.

For processes employing indirect cooling in scraped surface exchangers, cooling and wax crystallization are accomplished under conditions of very little agitation at a cooling rate in the range of about 1° to 8° F./min. (0.56° to 4.4° C./min. Under such conditions, without wall scrapers, wax tends to accumulate on the cold exchanger walls, interfering with heat transfer and causing increased pressure drop. Thus, wall scrapers are employed to remove the accumulated wax. Dewaxing solvents are employed to maintain fluidity of the oil in the coolers, and may be added before the oil is cooled or in increments during cooling. Often the oil is given a final dilution with solvent at the separation temperature for reducing solution viscosity such that wax separation is more efficient. Commonly, solvent added to the oil in such processes is at the same temperature, or somewhat higher temperature than the oil. Cold solvent, added at substantially lower temperatures than the oil, shock chills the oil resulting in formation of many small wax crystals which can be difficult to separate. Under controlled conditions, elongated wax crystals of good size are formed which are easy to separate and which contain little occluded oil.

Dilution chilling processes employ incremental addition of cold solvent, e.g. to +20° to −25° (−6.7° to −32° C.) to the oil at high degrees of agitation such that oil and solvent are completely mixed in less than one second. Under such conditions, wax precipitates in small, hard balls rather than elongated crystals. Such wax precipitates are easy to separate and retain very little oil.

Direct chilling processes employ a low boiling hydrocarbon, e.g. propylene, as dewaxing solvent and refrigerant. Waxy oil stock is diluted with sufficient low boiling hydrocarbon to provide the necessary cooling and provide the desired final dilution for separation of solid-wax from the oil-solvent solution. The low boiling hydrocarbon is vaporized from the oil-low boiling hydrocarbon solution, under conditions of reduced pressure, at a rate sufficient to cool the solution about 1° to 8° F./min. (0.56° to 4.4° C./min). Such cooling is continued until the desired separation temperature and amount of wax crystallization are obtained. At the separation temperature, sufficient low boiling hydrocarbon remains in solution with the oil to provide the desired fluidity for separation of wax. Agitation of the mixture being cooled is commonly provided for reduction of temperature and concentration gradients.

U. S. Pat. No. 3,972,779 to C. W. Harrison teaches a system for controlling a dewaxing apparatus. The system comprises a viscosity measurement of the waxy oil-wax crystal slurry mix and a refractive index measurement of the solvent to calculate incremental changes to dilution of wax oil with solvent.

U. S. Pat. No. 4,375,403 to C. W. Harrison et al. teaches a solvent dewaxing process employing direct heat exchange cooling of a solvent-oil mixture by direct heat exchange with an immiscible liquid chilling medium. The immiscible liquid may be any liquid which is substantially inert with respect to the solvent and oil stock, e.g. ethylene glycol.

U. S. Pat. No. 4,354,921 to H. J. Pitman et al. teaches a solvent dewaxing process in which a portion of the oil-solvent mixture is chilled to a temperature above its cloud point and a further portion is chilled to a temperature below its cloud point. The portions are combined to produce a mixture substantially at the cloud point. The combined mixture is further cooled to dewaxing temperature at which wax crystals are separated from the solvent and refined oil.

U.S. Pat. No. 3,764,517 to Bodemuller, Jr. teaches a control system for a solvent dewaxing process. Waxy oil is first heated to a temperature above the melting point of the wax. Cold solvent is admixed with the heated oil to shock chill the waxy oil-solvent mixture by direct heat exchange to a temperature below the wax melting point and above the wax crystallization temperature in the waxy oil-solvent mixture. The shock chilled oil solvent mixture is then chilled at a final chilling rate of 0.3° F./min. to 3.0° F./min. by indirect heat exchange to a filtration temperature about 10° F. below the desire pour point of the dewaxed oil product and filtered. A signal is generated corresponding to the filtrate flow rate and the shock chilling solvent temperature controlled in response to the signal.

*Petroleum Refiner*, Vol. 15, No. 6, June 1936, pp. 205–209 discusses the useful art of solvent dewaxing and the terminology used by those trained in the art.

DETAILED DESCRIPTION OF THE DRAWINGS

Figure 1:
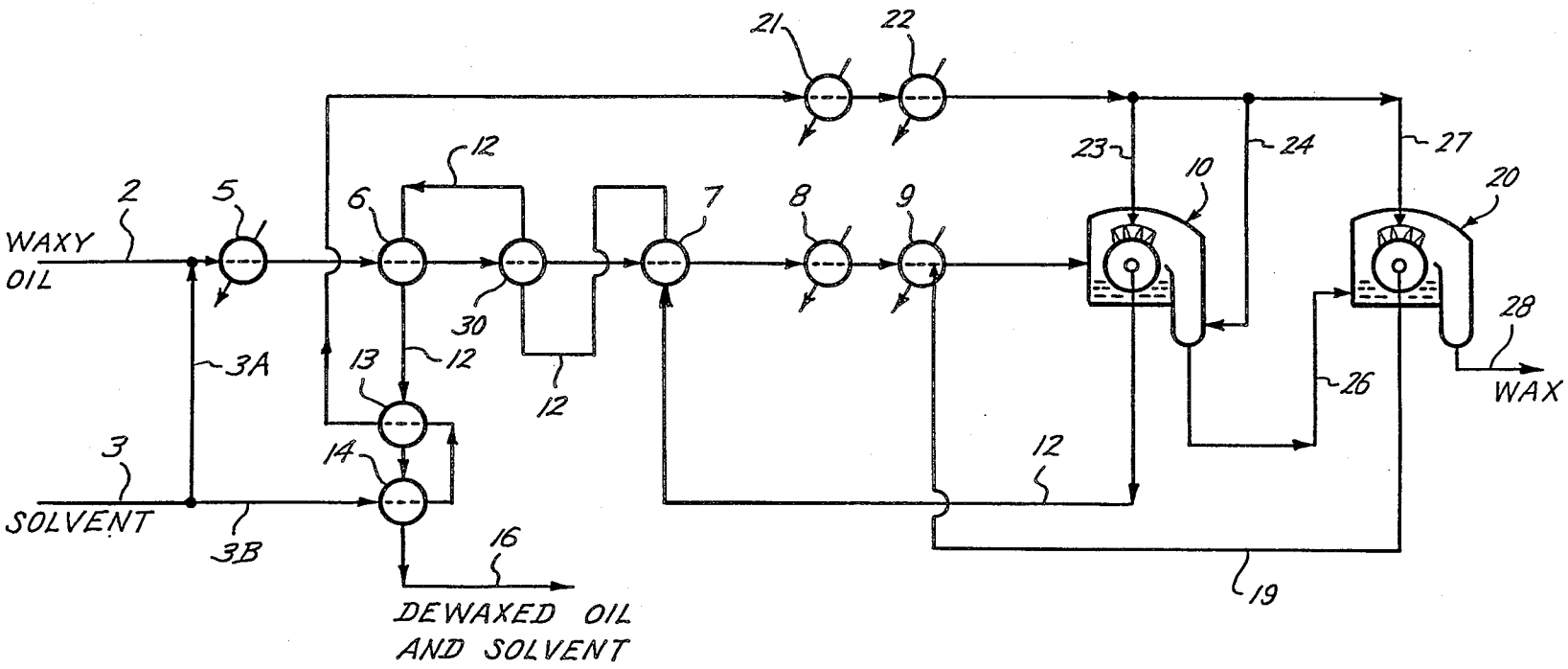
FIG. 1 is a simplified schematic flow diagram of a typical solvent dewaxing process.

FIG. 1 is a diagrammatic representation of a lube oil solvent dewaxing process.

With reference to FIG. 1, a waxy petroleum distillate supplied through line 2 is prediluted with solvent from line 3 via line 3A at a temperature effective for complete solution of the oil in solvent. In commercial operations, predilution of solvent and oil is usually carried out at a temperature in the range of 60° C. to 70° C. The mixture is then cooled in heat exchanger 5 where it is cooled by indirect heat exchange with cooling water and then passed through heat exchangers and chillers 6, 30, 7, 8 and 9 where it is cooled to the desired dewaxing temperature and delivered to primary filter 10.

The chillers may comprise a plurality of scraped wall double pipe heat exchangers of the type well known in the art. Suitably, chillers 6, 30, 7, 8, and 9 consist of double wall heat exchangers well known in the art which comprise an inner pipe through which the solvent-oil mixture is passed surrounded by an outer pipe or jacket of larger diameter supplied with a suitable coolant or heat exchange fluid. Coolant, comprising a dewaxed oil and solvent mixture obtained as a cold filtrate from a rotary drum vacuum filter 10 is supplied to the annulus or jacket of chiller 7 through line 12 and thereafter to the jacket of chiller 30 through line 12 and chiller 6 through line 12 warming the filtrate and cooling the incoming mixture of oil and solvent. The resulting warmed filtrate then flows in sequence through heat exchangers 13 and 14 where it is further warmed by heat exchange with solvent from line 3 and discharged through line 16 to a solvent recovery system, not illustrated.

The incoming mixture of oil feedstock and solvent is progressively cooled during its passage through heat exchanger-chillers 5, 6, 30, 7, 8 and 9 to the desired dewaxing temperature which may be in the range of −20° C. to −40° C. The resulting chilled mixture comprising solvent, dewaxed oil, and wax crystals is fed to primary filter 10. Additional solvent is added to the oil and solvent mixture through line 19, suitably as cold filtrate containing small amounts of low melting point wax and oil from repulp filter 20. Dilution of waxy petroleum oil stocks, especially lubricating oil base stocks, during the period of chilling and wax crystallization is a technique well known in the art. The cooling rate in the system of chillers 6, 30, 7, 8 and 9 is not greater than about 8° F. per minute, usually within the range of 1° F. to 6° F. per minute, and preferably within the range of 4° F. to 5° F. per minute. Chillers 8 and 9 are cooled by a suitable refrigerant, e.g. ammonia or propane from a source not illustrated in the FIG. 1.

In accordance with the present invention, the oil-solvent mixture undergoing chilling is first cooled in heat exchanger-chillers 6, 30, 7, 8, and 9 in first sensible heat exchange zone in which the temperature of the waxy oil is reduced at a specified rate to the wax crystallization temperature, characteristic of the waxy oil. The wax crystallization zone is characterized by relative isothermal heat transfer, at which temperature latent heat transfer causes the crystallization of a major portion of the wax. A final chilling zone is characterized by chilling to a selected filtration zone.

The three zones occur in sequence. The boundaries of each zone are subject to change based primarily on the characteristic of the oil, i.e. amount, molecular weight and molecular weight distribution of the wax to be removed. Hence the chiller and pass within each chiller wherein the chilling zone boundaries are found and where they are optimally located are not predictable and are found by temperature measurement alone.

Chillers 6, 30, 7, 8, and 9 suitably comprise scraped wall heat exchangers and, although shown diagrammatically in FIG. 1, may each represent groups of heat exchangers, preferably of the double pipe type, and typically comprising some 20 to 24 double pipe heat exchangers arranged in four parallel banks and equipped with mechanical scrapers to remove paraffin accumulations from the inner wall of the inner pipe through which the mixture of oil and solvent is passed. Chillers 6, 30, 7, 8 and 9 are a single series comprising five chillers, the preferred number of chillers in a series being three to six. Typically a solvent dewaxing process comprising 1 to 6 of these series of chillers.

The resulting mixture of solvent, dewaxed oil, and wax crystals is further cooled in chillers 30, 7, 8, and 9 and supplied at the desired dewaxing temperature to primary filter 10. Filter 10 is preferably a rotary drum type vacuum filter wherein the mixture of dewaxed oil and solvent is drawn through the filter and solid wax is retained on the filter surface. Filtrate, comprising a mixture of dewaxed oil and solvent, is withdrawn from the primary filter 10 through line 12 to the outer pipe or jacket of chillers 7 and 30, and then through chillers 6, 13 and 14 as already described.

Fresh solvent from line 3B is cooled in heat exchangers 13 and 14 by indirect heat exchange with filtrate from primary filter 10 thereby heating the filtrate and cooling the solvent. From heat exchanger 13, the solvent is passed through chillers 21 and 22 where it is cooled to the desired filtration temperature by heat exchange with suitable refrigerant, e.g. ammonia or propane supplied to the heat exchangers from sources not illustrated in the drawing. The chilled solvent from line 3B is employed as wash liquid and wax repulping medium.

Wax cake accumulated on the surface of the filter drum of filter 10 is washed with cold solvent from line 23, removed from the primary filter in a continuous manner, mixed with additional cold solvent supplied by line 24 to form a slurry, and passed through line 26 to repulping filter 20. Oil retained in the wax cake discharged from the primary filter 10 is recovered in the repulping filter 20. The repulping filter 20 operates in a manner analogous to that of the primary filter 10 at essentially the same temperature as that of the primary filter 10 or at a slightly higher temperature, e.g. 2° C. to 5° C. higher than the temperature of primary filter 10. Repulp filtrate is withdrawn from repulping filter 20 through line 19. The repulp filtrate is added to the lubricating oil-solvent mixture in chiller 9 for dilution of the lubricating oil feedstock.

Wax cake accumulating on the filter in repulping filter 20 is washed on the filter with chilled clean solvent from line 27, removed from the filter in a continuous manner and discharged through line 28 as a wax product of the process. Solvent supplied to filters 10 and 20 through lines 23, 24, and 27 is precooled to dewaxing temperature.

The dewaxed oil mixture, comprising typically about 30 wt% dewaxed hydrocarbon oil in admixture with solvent is passed through line 12, passing through heat exchanger-chillers 7 and 30 and then passed sequentially through heat exchanger-chillers 6, 13 and 14. The mixture of dewaxed oil and solvent is discharged through line 16 to solvent recovery facilities not illustrated in the drawing.

Figure 2:
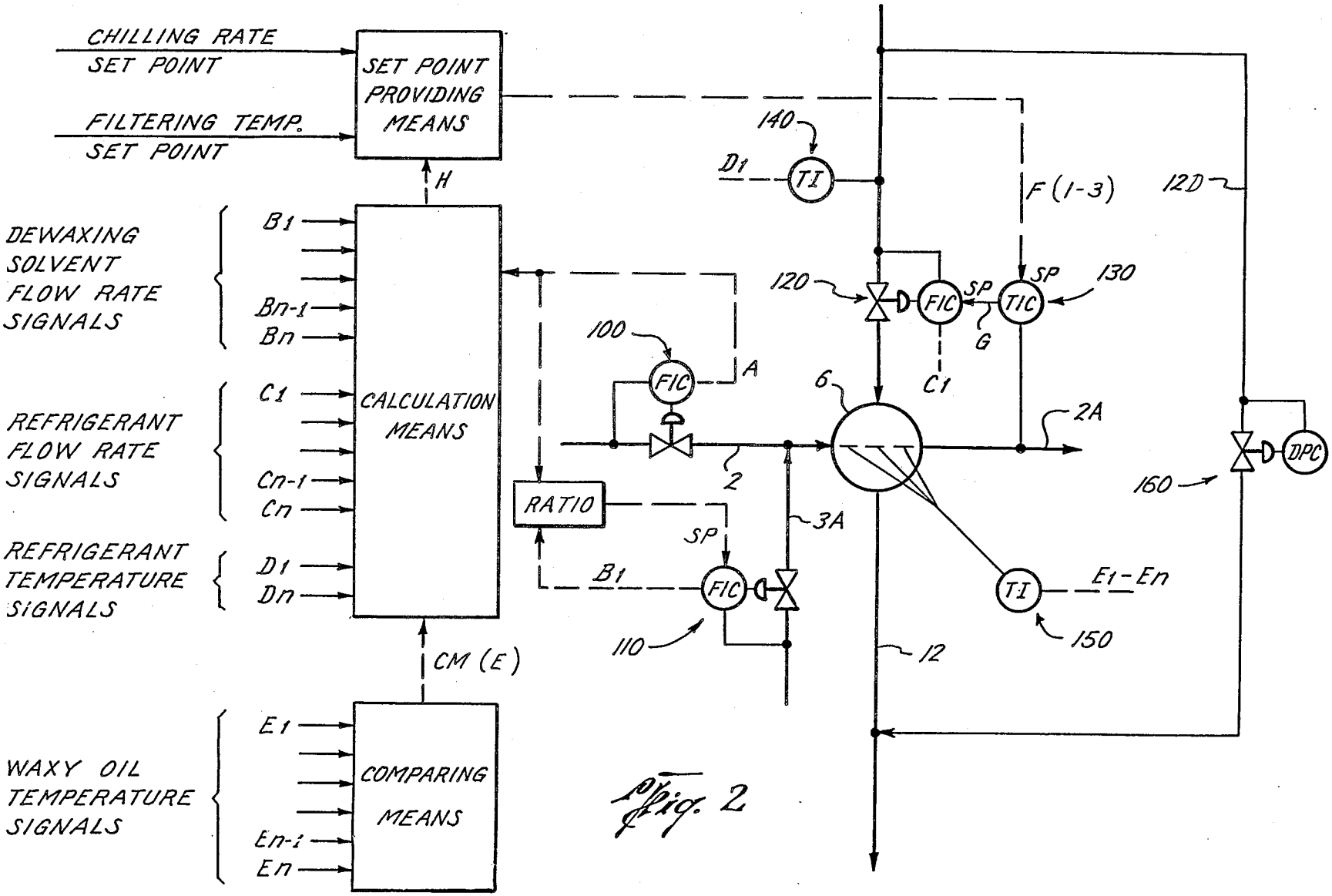
FIG. 2 is a schematic representation of the lube oil solvent dewaxing temperature control system.

Reference is made to FIG. 2, a representation of a system for controlling the temperature of waxy oil in a lube oil solvent dewaxing process. Chiller 6 of a series of at least three chillers is a double pipe heat exchange apparatus for the indirect exchange of heat between waxy oil through line 2 and refrigerant through line 12, in this example cold dewaxed oil and solvent. A portion of refrigerant may bypass chiller 6 via line 12D by means of pressure differential controlling (DPC) 160.

A first flow control means 100 in this case a flow control valve, flow indicator and controller controls the flow of waxy oil through line 2 and provides a signal A corresponding to waxy oil flow rate to Calculation Means.

A second flow control means 110 in this case a flow control valve, flow indicator and controller controls the flow rate of dewaxing solvent through line 3A which is mixed with waxy oil in line 2 on the way to chiller 6. Signal B1, corresponding to the solvent flow rate is passed to Calculation Means. Signal B1, is one of a plurality of signals (B1... Bn−1, Bn) corresponding to dewaxing solvent flow rate to each chiller in the series of chillers which is passed to Calculation Means.

A third flow control means 120, in this case a flow control valve, flow indicator and controller controls the flow rate of refrigerant through line 12 to chiller 6. Third control means 120 comprises a flow indicator which provides refrigerant flow rate signals ($C_1-C_n$) to Calculation Means. Temperature indicator controller 130 provides a set point to the flow controller. Temperature indicator 140 measures refrigerant temperature and optionally provides a signal D1, corresponding thereto. Signal D1 is one of a plurality of signals (D1... Dn) corresponding to refrigerant temperature to each chiller in the series of chillers which is passed to Calculation Means.

In a preferred embodiment a ratio control means provides a set point signal to the second flow control means in a ratio to the first flow control means signal.

A plurality of temperature sensing means 150 are arranged in sequence to measure the temperature of waxy oil as it progresses through chiller 6 and the remaining chillers in the series 30, 7, 8, and 9. The plurality of temperature sensing means 150 provides a plurality of signals $E_1$ to $E_n$ corresponding thereto which are provided to Comparing Means. The plurality of signals $E_1$ to $E_n$ is sufficient in number to sense three subordinate sequences of temperature sensing means 150 indicating three distinct chilling zones. The first chilling zone is a zone of sensible heat transfer, chilling the waxy oil to the temperature of a latent heat transfer zone, the temperature characteristic of the oil. The latent heat transfer zone is characterized by a relatively isothermal heat transfer. Relatively isothermal heat transfer is defined herein as heat transfer at a relatively small differential temperature with respect to time compared to the adjacent sensible heat transfer zones. In the latent heat transfer zone, heat transfer typically takes place with a temperature differential of 0° F. to 5° F., often a differential of only 0° F. to 3° F. The third chilling zone is a zone of sensible heat transfer extending from the temperature of the latent heat transfer zone to a selected filtering temperature. The plurality of temperature signals $E_1$ to $E_n$ is provided to comparing means which with the introduction of limits, is capable by subtraction of determining which members in the plurality of temperature sensing means 150 are in each zone and providing a signal CM(E) corresponding thereto.

A Temperature Set Point Providing Means provides a set point signal F(1–3) to temperature indicator and controller 130, which measures waxy oil temperature and by cascade provides a set point signal G to flow control means 120. The set point signal F(1–3) is provided according to the chilling zone to which third flow control means 120 flows refrigerant, determined by Comparing Means in conjunction with temperature sensing means 150.

The set point signal F may be one of three groups of signals selected according to the three chilling zones. A first set point signal $F_1$ is provided to third flow control means flowing refrigerant to the waxy oil chilling zone upstream of the latent heat transfer zone. This set point signal $F_1$ is provided in accordance with a selected chilling rate of 1° to 6° F./min., preferably 4° to 5° F./min. from a temperature of typically 120° F. to a temperature of 65° F. to 85° F.

A second set point signal $F_2$ is provided to third flow control means flowing refrigerant to the waxy oil chilling zone downstream of the latent heat transfer zone. This set point signal $F_2$ is provided in accordance with a selected filtering temperature typically −20° F. to −40° F. to achieve a desired product pour point of −10° F. to −20° F.

A third set point signal $F_3$ is provided to third flow control means flowing refrigerant to the waxy oil chilling zone in the latent heat zone. The latent heat zone is at a temperature of typically 65° F. to 85° F. characteristic of the waxy oil. The latent heat zone is a zone of relatively isothermal heat transfer wherein a major proportion of the wax crystallizes. Crystallization is an isothermal process. Because of variations in wax composition (i.e. molecular weight and molecular weight distribution), temperature has been noticed in practice to vary 5° F. up to 10° F. in this zone, though a variation of 0° F. to 5° F. is more typical and 0° F. to 3° F. not uncommon. This variation is caused entirely by the characteristics of the wax and oil and it is an objective of the control system to respond to it.

As the latent heat zone temperature is characteristic of the oil, it is also characteristic of waxy lube oil fractions that there is only one latent heat zone. Some wax crystallizes and precipitates through the entire chilling cycle. A major proportion of the wax up to 70 wt% or more determined by the waxy fraction, crystallizes in a single latent heat zone within a 5° F. to 10° F. differential within the range of 65° F. to 85° F.

The set point signal F is provided by Set Point Providing Means which receives a selected Chilling Rate Set Point and a selected Filtering Temperature Set Point. The set point signal F(1-3) is determined by Calculation Means which may be any means for performing algebraic calculations for example, digital microprocessor, analog computer or by hand. Calculation Means adjusts the set point signal F(1-3) via signal H to produce a corresponding set point signal G which takes account for refrigerant temperature, refrigerant flow rates, the flow rate of waxy oil and particularly the addition of incremental amounts of dewaxing solvent through the solvent dewaxing process. The actual temperature signal from temperature indicator and controller 130 corrects the calculation for the effects of chiller fouling. The calculation is then made by the simple algebraic combination of those factors along with their relative effect to achieve the selected waxy oil temperature objective, and provided to temperature indicator and controller 130 as a set point.

While particular embodiments of the invention have been described, it is well understood that the invention is not limited thereto since modifications may be made. It is therefore contemplated to cover by the appended claims any such modifications as fall within the spirit and scope of the claims.

What is claimed is:

1. A control system in combination with a lubricating oil dewaxing apparatus in which dewaxing solvent is mixed with a waxy oil at a selected ratio of solvent to waxy oil and the solvent-waxy oil mixture is chilled to a selected filtering temperature by indirect heat exchange with refrigerant in a heat exchange apparatus comprising a series of at least three chillers, to become a slurry mix which is provided to a filter, said control system comprising:

A. a first flow control means for controlling the flow rate of the waxy oil to the series of chillers and providing a signal corresponding thereto, B. second flow control means for controlling and providing a signal corresponding to the flow rate of dewaxing solvent to each chiller in the series of chillers, C. third flow control means for controlling the flow rate of refrigerant to each chiller in the series of chillers, D. a plurality of temperature sensing means arranged in sequence for sensing the temperature of the waxy oil flowing through the series of chillers and providing a plurality of signals corresponding thereto, the plurality of temperature sensing means sufficient in number to sense three sequential zones comprising: a chilling rate zone, an isothermal heat transfer zone and a filtering temperature zone, E. a refrigerant temperature sensing means, F. comparing means for receiving said plurality of waxy oil temperature signals and determining by comparison a sequence of adjacent temperature sensing means of said plurality of temperature sensing means at which a relatively isothermal heat transfer takes place thereby defining said isothermal heat transfer zone, G. set point providing means for providing to the third flow control means set point signals comprising:

1. a first set point signal provided to the third flow control means located upstream of said isothermal heat transfer zone to provide flow control of refrigerant to said chilling rate zone in accordance with a selected chilling rate of 1° to 6° F./min., 2. a second set point signal provided to the third flow control means located downstream of said isothermal heat transfer zone, to provide flow control of refrigerant to said filtering temperature zone in accordance with said selected filtering temperature, 3. a third set point signal provided to the third flow control means located at said isothermal heat transfer zone, in accordance with crystallizing a major portion of the wax in said waxy oil.

2. The control system of claim 1 comprising ratio control means for providing a set point signal to said second flow control means in a ratio to said first flow control means signal.

3. The control system of claim 1 wherein said comparing means determines the relatively isothermal heat transfer as a temperature differential of 5° F. or less.

4. The control system of claim 1 wherein said comparing means determines the relatively isothermal heat transfer as a temperature differential of 3° F. or less.

5. The control system of claim 1 wherein the series of chillers comprises 3 to 6 chillers.

6. The control system of claim 1 wherein the heat exchange apparatus comprises 1 to 6 series of chillers.

7. The control system of claim 1 wherein the third control means provides a selected chilling rate set point of 4° to 5° F./min.

8. The control system of claim 1 wherein the comparing means determines a temperature of relatively isothermal heat transfer in the range of 65° F. to 85° F.

9. The control system of claim 1 wherein the third control means provides a filtering temperature of −20° F. to −40° F.

10. A control system in combination with a lubricating oil dewaxing apparatus in which dewaxing solvent is mixed with a waxy oil at a selected ratio of solvent to waxy oil and the solvent-waxy oil mixture is cooled in three sequential cooling zones, the first a sensible heat zone in which the solvent-waxy oil mixture temperature is reduced to the temperature of the second, a latent heat zone characterized by relatively isothermal cooling at a temperature characteristic of the waxy oil, to form a wax crystal-oil slurry, and a third sensible heat zone in which the solvent-waxy oil mixture temperature is reduced to a selected filtering temperature for filtering a filtering means, the cooling of waxy oil carried out by indirect heat exchange with refrigerant in a heat exchange means comprising a series of chillers, said control system comprising:

1. a first flow control means for controlling the flow rate of the waxy oil to the series of chillers and providing a signal corresponding thereto,
2. a second flow control means for controlling and providing a signal corresponding to the flow rate of dewaxing solvent to each chiller of the series of chillers so as to control the solvent-waxy oil ratio,
3. a third flow control means for controlling the flow rate of refrigerant to each chiller of the series of chillers,
4. a plurality of temperature sensing means arranged in sequence for sensing the waxy oil temperature flowing through the series of chillers and providing a plurality of signals corresponding thereto, the plurality of temperature sensing means sufficient in number to sense the three sequential cooling zones,
5. a refrigerant temperature sensing means,
6. comparing means for receiving said plurality of waxy oil temperature signals and determining by comparison one sequence of adjacent temperature sensing means of said plurality of temperature sensing means at which relatively isothermal heat transfer takes place thereby identifying said latent heat zone,
7. flow rate set point providing means for providing flow rate set points to said third flow control means, said flow rate set points comprising:
   a. a first set point provided to the third flow control means located upstream of said latent heat zone to provide flow control of refrigerant to said first sensible heat zone in accordance with a selected chilling rate of 1° to 6° F./min.,
   b. a second set point provided to the third flow control means located downstream of said latent heat zone, to provide flow control of refrigerant to said third sensible heat zone in accordance with said selected filtering temperature,
   c. a third set point provided to the third flow control means located at the identified latent heat transfer zone in accordance with crystallizing a major portion of the wax in said waxy oil.

11. The control system of claim 10 comprising ratio control means for providing a set point signal to said second flow control means in a ratio to said first flow control means signal.

12. The control system of claim 10 wherein said comparing means determines the relatively isothermal heat transfer as a temperature differential of 5° F. or less.

13. The control system of claim 10 wherein said comparing means determines the relatively isothermal heat transfer as a temperature differential of 3° F. or less.

14. The control system of claim 10 wherein the series of chillers comprises 3 to 6 chillers.

15. The control system of claim 10 wherein the heat exchange apparatus comprises 1 to 6 series of chillers.

16. The control system of claim 10 wherein the third control means provides selected chilling rate set point of 4° to 5° F./min.

17. The control system of claim 10 wherein the comparing means determines a temperature of relatively isothermal heat transfer in the range of 65° F. to 85° F.

18. The control system of claim 10 wherein the third control means provides a filtering temperature of −20° F. to −40° F.

* * * * *